United States Patent [19]

Kuraoka

[11] 4,421,537

[45] Dec. 20, 1983

[54] HELIUM GAS LIQUEFYING APPARATUS

[75] Inventor: Yasuo Kuraoka, Sapporo, Japan

[73] Assignee: Hoxan Corporation, Sapporo, Japan

[21] Appl. No.: 419,824

[22] Filed: Sep. 20, 1982

[30] Foreign Application Priority Data

Oct. 9, 1981 [JP] Japan ..... 56-161226

[51] Int. Cl.[3] ..... F25J 3/00; F25J 3/06; F25J 5/00

[52] U.S. Cl. ..... 62/22; 62/40

[58] Field of Search ..... 62/22, 40, 9, 11, 38, 62/39; 423/659

[56] References Cited

U.S. PATENT DOCUMENTS 3,815,376 6/1974 Lofredo et al. ..... 62/22

*Primary Examiner*—Frank Sever

*Attorney, Agent, or Firm*—George B. Oujevolk

[57] ABSTRACT

A helium gas liquefying apparatus which has a compressor receiving helium gas stock, plural heat exchangers connected in series with each other via a series liquefying line, plural expansion engines connected in parallel with the corresponding heat exchangers, a Joule-Thompson's valve connected via the liquefying line, a series return line disposed in the reverse flow of the heat exchangers to the liquefying line, a three-way valve having one passage connected between the return line and the return valve and the other passage branched therefrom to the inlet of the compressor, and an additional line connected from the compressor to the three-way valve. Thus, high efficiency of Joule-Thompson's effect can be obtained.

1 Claim, 2 Drawing Figures

HELIUM GAS LIQUEFYING APPARATUS

BACKGROUND OF THE INVENTION

This invention relates to a helium gas liquefying apparatus which produces liquefied helium gas by introducing helium gas stock and suitably cooling the gas.

A conventional helium gas liquefying apparatus of this type has a structure as shown in FIG. 1. In the structure, a helium gas bomb 1, a compressor 2, a cooler 3 and a liquefied helium reservoir 4 have been connected by piping with a J-T valve 5 (which performed Joule-Thompson's effect), a return valve 6 and control valves 7 and 8. The following preliminary various operations have been carried out before liquefied helium gas (LHe) was produced in the reservoir 4.

The valves 5 and 5 are closed, the compressor 2 is then operated, helium gas (GHe) is introduced from the bomb 1 into the compressor 2, and the GHe compressed by the compressor 2 is then fed to the cooler 3. The cooler 3 includes a plurality of heat exhangers $9_1$, $9_2$, $9_3$, $9_4$, $9_5$ and expansion engines $10_1$, $10_2$ known per se. A series liquefying line 11 and a series return line 12 with the respective heat exchangers are provided in parallel with one another via a reverse flow heat exchanging arrangement. When the compressed GHe is introduced from the inlet 11' of the line 11 into the cooler 3, the expansion engines $10_1$, $10_2$ are respectively connected in parallel with the second and fourth heat exchangers $9_2$ and $9_4$ between the lines 11 and 12, and the GHe exhausted from the line 11 of the first heat exchanger $9_1$ is branched to the first expansion engine $10_1$, is expanded in the engine $10_1$, and the GHe which is thus lowered at its temperature via the expansion engine $10_1$ is sequentially passed through the line 12 of the second and first heat exchangers $9_2$ and $9_1$ and is returned to the inlet of the compressor 2 circularly. Thus, the GHe is gradually cooled via the first and second heat exchangers $9_1$, $9_2$.

Similarly, the second expansion engine $10_2$ cools the GHe branched from the third heat exchanger $9_3$, and the GHE is returned sequentially through the fourth, third, second and first heat exchangers $9_4$, $9_3$, $9_2$, $9_1$ to the compressor 2. In this manner, the GHe is progressively cooled even via the circulating line and the first preliminary operation for cooling the GHe is carried out by circulating the GHe to the fourth heat exhanger $9_4$.

When the temperature of the inlet of the second expansion engine $10_2$ is thus decreased to a temperature lower than 20° K., the valve 5 is opened by the second preliminary operation, thereby cooling the line 11 of the fifth heat exchanger $9_5$, the valve 5 and the pipes connected thereto with the GHe thus cooled. Thus, the GHe is circulated from the return line 13 via the reservoir 4 to the inlet of the compressor 2 by opening the valve 8.

When the various units and components are thus cooled, the closed return valve 6 is then opened, the control valve 8 is closed, thereby circulating the GHe from the reservoir 4 from the return valve 6, the inlet 12' to outlet 12'' of the line 12 and the inlet of the compressor 2. Thus, the third preliminary operation for cooling the return line has thus been completed. Thus, the cooled GHe from the fifth heat exchanger $9_5$ via the valve 5 is lowered at its temperature due to the isenthalpic expansion, and is stored as LHe in the reservoir 4. The J-T valve 5 is applied by the Joule-Thompson's effect known per se, to allow a temperature fall below a predetermined temperature and a temperature rise above a predetermined temperature. The boundary temperature (the Joule-Thompson coefficient is 0) between the temperature changes is called "an inversion temperature of the gas", and the inversion temperature of the helium is 50° K.

Since the conventional helium gas liquefying apparatus is thus constructed, the return valve 6 is heated through the valve 6 accommodating considerable amount of heat capacity, when the valve 6 is opened in the third preliminary operation. Further, the GHe thus heated is introduced into the line 12 of the fifth heat exchanger $9_5$, and the fifth heat exchanger $9_5$ is thus heated, with the result that the GHe is not cooled in the fifth heat exchanger $9_5$ but is, on the contrary, heated. Thus, the GHe thus heated is fed to the valve 5, and is heated to 70° to 80° K., thereby exceeding the inversion temperature of the GHe. The GHe is thus further heated, resulting in no production of the LHe even if the apparatus is started. Or, even if the GHe does not exceed the inversion temperature, the GHe thus heated to high temperature deteriorates the efficiency of the Joule-Thompson's effect as its drawback.

SUMMARY OF THE INVENTION

Accordingly, a primary object of this invention is to provide a helium gas liquefying apparatus in which all the aforementioned drawbacks and disadvantages of the conventional helium gas liquefying apparatus and high efficiency of Joule-Thompson's effect can be obtained.

Another object of this invention is to provide a helium gas liquefying apparatus which is capable of proving stable liquefaction of the helium.

Still another object of the present invention is to provide a helium gas liquefying apparatus which can eliminate the temperature rise of the GHe exhausted from a series liquefying line to the J-T valve in its heat exchanger.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
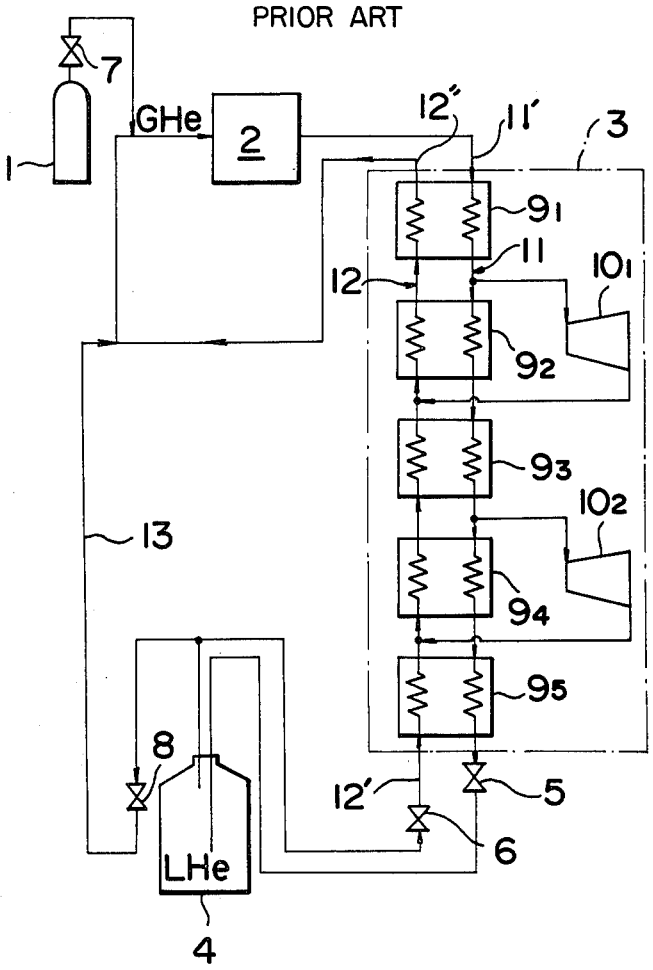
FIG. 1 PRIOR ART
FIG. 1 is a schematic piping arrangement view showing a conventional helium gas liquefying apparatus.

The present invention will now be described in more detail with reference to the accompanying drawings, which show a preferred embodiment of the present invention. In FIG. 2, the helium gas liquefying apparatus of the present invention comprises, as similarly to those of the conventional helium gas liquefying apparatus in FIG. 1, a helium gas bomb 1, a compressor 2, a cooler 3, a liquefied helium reservoir 4, a J-T valve 5, a return valve 6, a control valve 7, first to fifth heat exchangers $9_1$ to $9_5$, first and second expansion engines $10_1$, $10_2$, a series liquefying line 11 and a series return line 12.

Figure 2:
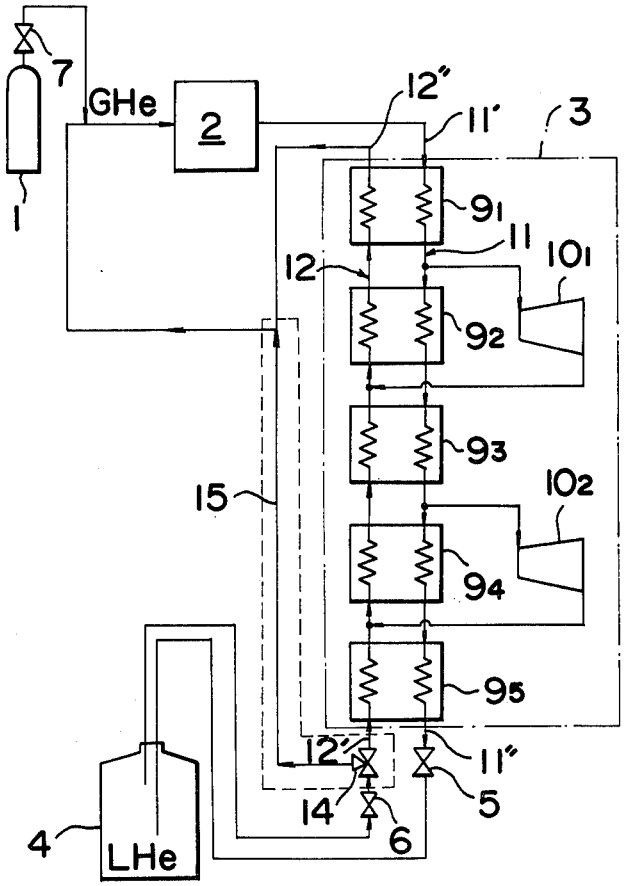
FIG. 2 is a schematic piping arrangement view showing a preferred embodiment of a helium gas liquefying apparatus according to the present invention.

In the embodiment of the present invention, the apparatus does not have the control valve 8 and the return line 13 in FIG. 1. Further, a three-way valve 14 is inserted among the return valve 6 and the inlet 12' of the line 12. The return valve 6 openably communicates with the inlet 12' of the line 12 through a passage opened by operating the valve 14, and the return valve 6 further communicates via an additional line 15 with the inlet of the compressor 2 via another passage opened by operating the valve 14.

In operation of the helium gas liquefying apparatus according to the present invention, the valves 5 and 6 are initially closed in the same manner as the conventional apparatus and the compressor 2 is started by the first preliminary operation. Thus, as was described in detail with respect to the conventional apparatus, the first and second expansion engines $10_1$, $10_2$ are operated, the GHe is circulated from the compressor 2 to the first to fourth heat exchangers $9_1$ to $9_4$, thereby lowering the GHe at its temperature. However, in the second preliminary operation to be performed when the inlet temperature of the second expansion engine 10H2Y is decreased to a temperature lower than 20° K., not only the valves 5 and 6 are opened at the outlet 11' of the line 11, but the valve 14 is operated to communicate the valve 6 with the line 15. Thus, the GHe cooled by the cooler 3 is in turn circulated through the valve 5, the reservoir 4, the return valve 6, the other passage of the valve 14 and the line 15 to the inlet of the compressor 2, thereby cooling the valves 5, 6 and 14.

When these valves 5, 6 and 14 are cooled to a temperature lower than 20° K. in this manner, the third preliminary operation for switching the valve 14 is carried out to introduce the GHe passed through the valve 6 to the line 12 of the cooler 3 from the inlet 12' of the line. Thus, the third preliminary operation has been completed.

It should be understood from the foregoing description that since the helium gas liquefying apparatus of the present invention thus comprises the three-way valve 14 interposed between the valve 6 and the inlet 12' of the line provided at the cooler 3 to communicate therebetween and an arrangement for returning the GHe from the valve 6 via the valve 14 and the line 15 to the compressor 2 without the intermediary of the line 12 when the communication is interrupted, the GHe can be fed to the heat exchanger of the final stage of the cooler 3 after the GHe is sufficiently cooled via the valve 6, the GHe flowed from the line 11 to the valve 5 in the heat exchanger is not heated as in the conventional apparatus. Therefore, such difficulties that the liquefied helium cannot be obtained even after the liquefaction is initiated, and the efficiency of the liquefaction is bad, can be completely eliminated, the efficiency of the J-T effect can be improved, stable liquefaction of the helium can be proved, and the above described features and advantages can be remarkably improved by providing a small-sized additional members at the suitable position of the conventional apparatus.

What is claimed is:

1. A helium gas liquefying apparatus, comprising:

(a) a liquefied helium reservoir (4);

(b) a compressor (2) with inlet means receiving a helium gas stock and connected to said reservoir;

(c) a plurality of heat exchangers ($9_1$, $9_2$) connected in series with each other via a series liquefying line (11);

(d) a plurality of expansion engines (10, $10_2$), connected in parallel with corresponding heat exchangers;

(e) a Joule-Thompson valve (5) connected from the outlet of said liquifying line to said reservoir;

(f) a series return line (12) with an inlet (12' ), said series return line being disposed in reverse flow of said heat exchangers to said liquefying line and connected to said compressor inlet means;

(g) a return valve (6) connected to said reservoir;

(h) means for eliminating a temperature rise in the helium gas exhausted from a series liquefying line to the Joule-Thompson valve including a three-way valve having one passage connected to said return line inlet (12' ) from said return valve, and a second passage branched therefrom connected to the inlet of said compressor inlet means; and, (i) an additional line connected from the inlet of said compressor to said three-way valve.

* * * * *